US009190719B2

(12) United States Patent
Kerselaers

(10) Patent No.: US 9,190,719 B2
(45) Date of Patent: Nov. 17, 2015

(54) MULTIBAND ANTENNA

(75) Inventor: Anthony Kerselaers, Herselt (BE)

(73) Assignee: NXP B.V., Eindhoven (NL)

( * ) Notice: Subject to any disclaimer, the term of this patent is extended or adjusted under 35 U.S.C. 154(b) by 452 days.

(21) Appl. No.: 13/405,378

(22) Filed: Feb. 27, 2012

(65) Prior Publication Data

US 2012/0223862 A1 Sep. 6, 2012

(30) Foreign Application Priority Data

Mar. 3, 2011 (EP) ..... 11250244

(51) Int. Cl.

| | |
|---|---|
| ***H01Q 1/38*** | (2006.01) |
| ***H01Q 1/32*** | (2006.01) |
| ***H01Q 9/40*** | (2006.01) |
| ***H01Q 5/357*** | (2015.01) |

(52) U.S. Cl.

CPC ..... *H01Q 1/38* (2013.01); *H01Q 1/3275* (2013.01); *H01Q 5/357* (2015.01); *H01Q 9/40* (2013.01)

(58) Field of Classification Search

USPC ..... 343/700 MS, 702

See application file for complete search history.

(56) References Cited

U.S. PATENT DOCUMENTS

| | | | | |
|---|---|---|---|---|
| 5,754,145 | A | 5/1998 | Evans | |
| 5,986,606 | A | 11/1999 | Kossiavas et al. | |
| 6,188,366 | B1 | 2/2001 | Yamamoto et al. | |
| 6,417,816 | B2 * | 7/2002 | Sadler et al. | 343/795 |
| 6,819,290 | B2 * | 11/2004 | Hani et al. | 343/700 MS |
| 6,906,678 | B2 | 6/2005 | Chen | |
| 7,612,720 | B2 | 11/2009 | Kerselaers | |
| 2003/0080904 | A1 * | 5/2003 | Chen | 343/700 MS |
| 2003/0098812 | A1 | 5/2003 | Ying et al. | |
| 2004/0201527 | A1 | 10/2004 | Hani et al. | |
| 2008/0001824 | A1 | 1/2008 | Castaneda et al. | |
| 2008/0180342 | A1 | 7/2008 | Kerselaers | |

FOREIGN PATENT DOCUMENTS

| | | | |
|---|---|---|---|
| CN | 1244053 | A | 2/2000 |
| CN | 1551410 | A1 | 1/2004 |

(Continued)

OTHER PUBLICATIONS

Lulian R. "PIFA—Planar Inverted F Antenna", retrieved from the Internet on Feb. 3, 2011 at: http://www.qsl.net/va3iul/Antenna/PIFA/PIFA_Planar_Inverted_F_Antenna.pdf, 4 pgs.

(Continued)

*Primary Examiner* — Hoang V Nguyen
*Assistant Examiner* — Hai Tran

(57) ABSTRACT

A multiband antenna comprising a substrate having first and second surfaces. A first conductive plate located on the first surface comprises a first conductive region couplable to ground by a shorting element, and a second conductive region. The first and second conductive regions are located to define a gap therebetween. The antenna also has a second conductive plate on the substrate's second surface. The second conductive plate is coupled to a signal terminal of a feeding port and positioned to provide capacitance with the first conductive region. The antenna also has a third conductive plate on the substrate's second surface. The third conductive plate is positioned to provide capacitance with the second conductive region, and a connecting conductor configured to electrically couple the third conductive plate to the second conductive region.

15 Claims, 14 Drawing Sheets

(56) References Cited

FOREIGN PATENT DOCUMENTS

| | | | |
|---|---|---|---|
| CN | 2840344 | Y | 11/2006 |
| CN | 2909556 | Y | 6/2007 |
| CN | 200979907 | Y | 11/2007 |
| CN | 101867086 | A | 10/2010 |
| DE | 10 2005 054 286 | A1 | 5/2007 |
| DE | 10 2008 043 242 | A1 | 4/2010 |
| EP | 1 018 779 | A2 | 7/2000 |
| EP | 1184934 | A1 | 3/2002 |
| EP | 1 414 109 | A2 | 4/2004 |
| EP | 1 471 599 | A1 | 4/2004 |
| EP | 2 256 859 | A1 | 12/2010 |
| TW | 560107 | B | 11/2003 |

OTHER PUBLICATIONS

Extended European Search Report for European Patent Appln. No. 11250244.8 (Jul. 15, 2011).

Office Action for counterpart application CN 201210048193.9 Jan. 2, 2014.

Office Action from counterpart application 201210048193.9 May 25, 2015, 2012.

Rejection from counterpart application CN 201210048193.9 (Jan. 16, 2015), 2012.

* cited by examiner

MULTIBAND ANTENNA

CROSS-REFERENCE TO RELATED APPLICATIONS

This application claims the priority under 35 U.S.C. §119 of European patent application no. 11250244.8, filed on Mar. 3, 2011, the contents of which are incorporated by reference herein.

The present invention relates to the field of multiband antennas, in particular, although not exclusively, to a compact multiband antenna that provides for independent tuning of the antenna impedance properties for two frequency bands by two separate double resonance tuning elements.

Today's vehicles are equipped with many wireless devices so as to receive radio and television broadcasts, for cellular telecommunications and GPS signals for navigation. In the future, even more communication systems will be implemented for "intelligent driving" such as dedicated short range communication (DSRC). As a result, the number of automotive antennas is increasing and miniaturization requirements are becoming an important consideration for reducing the unit cost price of the antenna systems. The largest cost is the cabling between the antennas and the respective electronic devices; typically this cabling costs 5 Euro per coaxial cable.

Multiple antennas are often concentrated in one antenna unit, called a "shark fin" unit. A shark fin unit may be positioned on the back of the rooftop of a car.

According to a first aspect of the invention, there is provided a multiband antenna comprising:

a substrate having a first surface and a second surface;

a first conductive plate on the first surface of the substrate, the first conductive plate comprising a first conductive region and a second conductive region;

wherein the first conductive region is couplable to ground by a shorting element, and the first conductive region and second conductive region are located so as to define a gap therebetween;

a second conductive plate on the second surface of the substrate, the second conductive plate coupled to a signal terminal of a feeding port, and wherein the second conductive plate is aligned, possibly in a plane of the substrate, in order to provide capacitance with the first conductive region;

a third conductive plate on the second surface of the substrate, wherein the third conductive plate is aligned, possibly in the plane of the substrate, in order to provide capacitance with the second conductive region; and a connecting conductor configured to electrically couple the third conductive plate to the second conductive region.

The multiband antenna can provide a compact and low cost implementation of a multiband antenna that can adequately operate at frequencies in the region of 0.5 GHz to 3.5 GHz, or even higher, whilst maintaining a small physical size. The physical size of the multiband antenna can be small enough to fit within a shark fin unit for an automobile, and may have a height (longitudinal length) that is less than about 55 mm.

The structure of the conductive plates on the first and second surfaces of the substrate can provide a convenient implementation for double tuning the frequency bands such that they can provide acceptable performance at a range of frequencies of interest.

The substrate may be FR4 printed circuit board material. Such a construction can be very low cost to manufacture and is proven to be adequate in the harsh environments of automobile use. The conductive plates may be in the form of copper deposited on the substrate, or any other suitable surface layer.

The feeding port may be a connection between the antenna and radio frequency (RF) circuitry that allows a signal to be transmitted from the RF circuitry to the antenna or vice versa. The feeding port may comprise a region of conductive material that is in electrical contact with the second conductive plate, such a region can be referred to as a signal terminal. In use, the signal may be fed to the antenna by coupling a wire from a coaxial cable to the signal terminal of the feeding port. Such signals may be referred to as transmit and receive signals. RF integrated circuits may be positioned directly below the antenna to eliminate or reduce the need for coaxial cables between the feeding port of the antenna and the RF circuitry.

The feeding port may also be in comprise a contact point, referred to as a ground terminal, where a grounded conductor can be coupled to a shielding element of a coaxial cable. Alternatively, the feeding port could be directly coupled to a circuit board containing radio circuitry. This capability allows the antenna to be readily integrated with existing systems.

The first and second conductive regions can be the principle radiating portions of the antenna and may be suitable for transmitting or receiving RF electromagnetic radiation. Aspects of the invention allow for the RF signal in the first conductive plate to be driven capacitively by the signal applied directly to the feeding port or second conductive plate. The first conductive region of the first conductive plate (on the first surface of the substrate) and the second conductive plate (on the second surface of the substrate) may at least partially overlap in the plane of the substrate in order to provide capacitance between the first conductive region and second conductive plate. In a similar manner, the second conductive region of the first conductive plate (on the first surface of the substrate) and the third conductive plate (on the second surface of the substrate) may at least partially overlap in the plane of the substrate in order to provide capacitance between the second conductive region and third conductive plate The capacitance provided by the second and third conductive plates may be chosen to at least partially compensate for the natural input impedance of the antenna operating at a given frequency or frequencies.

The first conductive region and the second conductive region may be coupled at a coupling region of the first conductive plate on the first surface of the substrate. The coupling region on the first surface may be aligned, in the plane of the substrate, with the position of the feeding port on the second surface of the substrate. The capacitance provided between the first conducting plate and the second conducting plate may be considered as being in series with the input impedance of the antenna.

The second conductive plate may be aligned with relation to the position of the second conductive region of the first conductive plate in order to capacitively drive the first conductive plate. The second conductive plate may also be referred to as a capacitive plate. This feeding method can create an additional series resonance circuit for the antenna creating a double resonance tuning effect.

The feeding port may be configured to provide or draw a signal to or from the first conductive region and the second conductive region. The feeding port may provide this functionality due to the capacitive coupling of the first and second conductive plates. The feeding port may comprise a direct coupling of the second conductive plate to a wire, or a connection to another circuit board.

The first conductive region of the first conductive plate may be configured to transmit or receive a signal having a frequency in a first frequency band. The first conductive region together with the second conductive region of the first conductive plate may be configured to transmit or receive a signal having a frequency in a second frequency band. The first frequency band may be at a higher frequency than the second frequency band.

The bandwidth of the two frequency bands can be affected by setting parameters of the antenna in order to provide double resonance tuning of the upper and lower frequency band. Such parameters that can be used to control the operation of the frequency bands may comprise the length, shape, area and relative position of the various conductive plates and conductive regions of the multiband antenna. The values of these properties may be set during the design of the antenna in order to achieve the desired frequency response. The first conductive region of the first conductive plate may be substantially rectangular and the second conductive region of the first conductive plate may be substantially the shape of an inverted 'L'. It will be appreciated that a "substantially rectangular" shape can also cover a square. The gap may be a separation between an edge of the first conductive region and a facing edge of the 'L' shaped second conductive region. The coupling region between the first and second regions of the first conductive plate may be at a position that is proximal to the bottom of the inverted 'L' of the second conductive region. The 'L' shaped second conductive region may be located around two edges of the substantially rectangular first conductive region. These configurations have been found to occupy a small amount of PCB/substrate space and therefore can aid in the task of accommodating the antenna in a confined space, such as within a radome fin for a vehicle.

The antenna may be encapsulated in a radome suitable for mounting on a vehicle. This radome may be constructed from any suitable material such as, for example, metal, glass, plastic, fibre glass or another composite material, or any other suitable material. The vehicle on which the radome is mounted may be a car, train, lorry, van, cycle, plane, glider, boat, submarine, or any other means of transportation.

Facing edges between any of the conductive plates or regions need not be straight and can encompass bends or corners according to various aspects. Also, the term 'edge' used herein need not encompass a whole edge, and may be understood to comprise only a section or part of an entire edge of a structure.

The gap may be considered as having a continuous length around bends or corners in the edges of the first and second regions. The length of the gap may correspond to the length of the shorter of the facing edges, which may the distance that an edge of the first conductive region overlaps with an edge of the second conductive region, or vice versa. Alternatively, the length of the gap may correspond to the longer of the facing edges, which may go beyond the overlap of the edges.

The antenna may further comprise a fourth conductive plate on the first surface of the substrate. The fourth conductive plate may be coupled to the shorting element and couplable to ground. The fourth conductive plate in combination with the shorting element may provide inductance with the first conductive plate. The fourth conductive plate, which may also be known as a ground bar or grounding bar, can be used to create a fixed distance between the first conductive plate and a conductor with the ground potential. This allows for greater certainty in the performance of the antenna as the distance between the radiating element, that is, the first conductive plate, and the ground is fixed.

The fourth conductive plate may be located such that it has an edge that faces an edge of the first conductive plate. Specifically, an edge of the fourth conductive plate may face an edge of the first conductive region of the first conductive plate. An edge of the fourth conductive plate and an edge of the first conductive plate may be broadly parallel.

The antenna may further comprise a fifth conductive plate on the second surface of the substrate. The fifth conductive plate, which like the fourth conductive plate can also be known as a ground bar or grounding bar, can be used to create a fixed distance between the second conductive plate and a conductor with the ground potential. This allows for greater certainty in the performance of the antenna as the distance between the capacitive surface, which drives the radiating surface, and the ground is fixed.

The fifth conductive plate may be located such that it has an edge that faces an edge of the second conductive plate. An edge of the fifth conductive plate and an edge of the second conductive plate may be broadly parallel.

Reference herein to 'the ground bar' may be a reference to either the fourth conductive plate, the fifth conductive plate, or to both the fourth conductive plate and the fifth conductive plate.

A ground bar may be located on the surface of the substrate such that it is adjacent to a ground plane when the antenna is mounted on a ground plane. The ground bar may be electrically coupled to the ground plane. The ground bar may be located at an edge of the substrate. A ground bar may generally extend across the majority of the lateral width of the substrate, and possibly at least across a lateral width that corresponds to at least the lateral width of the first conductive plate and/or second conductive plate. A ground bar may extend laterally between the shorting element and a sixth conductive plate. The ground terminal of the feeding port may be located on the ground bar. Alternatively, the ground bar may be coupled to any earthed or grounded surface or circuit element.

The antenna may further comprise a sixth conductive plate on the first surface of the substrate. The sixth conductive plate may be configured to provide impedance between the second conductive region and ground in order to affect the frequency input impedances of a higher frequency band. The sixth conductive plate may be coupled to the ground or to a ground plane. The sixth conductive plate, which may also be known as a tuning bar, may be positioned so that it has an edge that faces an edge of the first conductive plate. Specifically, the sixth conductive plate may have an edge that faces an edge of the second conductive region of the first conductive plate. An edge of the tuning bar may be broadly parallel with an edge of the second conductive region. The sixth conducive plate may extend longitudinally from the ground plane such that at least a portion of the sixth conductive portion runs generally parallel to the second conductive region. The sixth conductive plate may be coupled to one end of the laterally extending fourth conductive plate.

Alternatively, the sixth conductive plate may be provided as a separate discrete element that is not present on the surface of the substrate. An example of such an arrangement is that of a grounded rod, pole or wire located proximally to the antenna so as to affect the frequency input impedances of a higher frequency band.

The first conductive region may be further configured to provide inductance between the feeding port and ground. This may be achieved either directly, or by inductive coupling with another element of the antenna, such as a ground bar.

The second conductive plate may be further configured to provide inductance between the feeding port and ground.

This may also be achieved either directly, or by inductive coupling with another element of the antenna, such as a ground bar.

The antenna may further comprise a connecting conductor that may be configured to directly electrically couple the second conductive region and the third conductive plate. A via is an example of a connecting conductor. A via may be an electrically conductive circuit element, such as a wire connection. Such a connection can allow the third conductive plate to provide inductive reactance as well as capacitive reactance to the first conductive plate on the opposite side of the substrate.

The impedance properties of the conductive plates may affect the tuning of a first and second frequency bands. These properties can include the conductivity of the plates, the area of the plates, the geometric relationship between the plates and the electrical properties of any interconnectors such as the via between the first conductive plate and the third conductive plate.

The antenna may further comprise a ground plate. The first conductive plate may be coupled to the ground plate by the shorting element.

The substrate may extend in a direction that is substantially perpendicular to the ground plate. This can provide a convenient structure of the antenna that is suitable for fitting within a shark fin unit. In some examples the rooftop of the automobile may be considered as an extension of the ground plate.

The presence of a ground plate, which can also be known as a ground plane, may improve the operating efficiency of the multiband antenna. The multiband antenna may be mounted vertically on a horizontal ground plate. The horizontal and vertical directions may be relative to the antenna and not the reference system defined by the physical orientation of the antenna with the surface of the earth.

The shorting element may be located distally from the feeding port in order to provide an input impedance at the feeding port. The shorting element may be at the furthest extremity from the feed port in a direction that is both parallel with the plane of the ground plate, and parallel with the plane of the substrate.

The first conductive plate may form a one quarter wavelength monopole antenna suitable for use at multiband radio frequencies. The first conductive region may form a one quarter wavelength monopole antenna suitable for use at a first frequency band. The first conductive region together with the second conductive region may form a one quarter wavelength monopole antenna suitable for use at a second, lower, frequency band. The arrangement of the first and second conductive plates may be configured such that the antenna is effective at two distinct frequency bands. The first and second frequency bands may be tailored to be suitable for use with certain radio frequency standards, and such standards can include:

GSM 900: 880-960 MHz
GSM 1800: 1710-1880 MHz
UMTS: 1930-2170 MHz
GSM 850: 824-894 MHz
PCS: 1850-1990 MHz

The multiband antenna may also be implemented such that it has a high return loss for "other frequency bands", so forming a suppression band or suppression bands. This property can enable the multiband antenna to be situated in close proximity to other antenna operating in the "other frequency bands" and not interfere with the operation of these other antenna. For example, the multiband antenna may be designed so as to suppress the GPS frequency band at 1575.42±1.023 MHz.

The suppression band may be formed by suitable design of the individual elements of the antenna. Factors affecting the bandwidth of the higher and lower frequency band and any suppression band may include the area of the conductive regions and plates, the lengths of the edges of the conductive regions and plates, the alignment between the surfaces and the ground, the distance between the feeding port and the shorting element, the length of the gap between the first and second conductive regions, the configuration of the multiband antenna with a ground plate and/or the presence of other conductive surfaces adjacent to the antenna.

The antenna may be shaped so as to fit within a shark fin unit, for example, an edge of the antenna that is distal from the ground plane may be sloped so that it corresponds to the internal shape of the shark fin unit. The maximum height of the antenna may be less than 55 mm in order to fit within the shark fin unit. It may not be possible to manufacture prior art antennas that have a suitable frequency response for the frequency bands of interest that is capable of fitting within known shark fin units.

There may be provided a shark fin unit comprising any multiband antenna disclosed herein.

There may be provided an automobile, such as a car, fitted with any multiband antenna or shark fin unit disclosed herein.

The above aspects of the invention are described by way of example in further detail below with reference to the accompanying drawings, in which.

Figure 1:
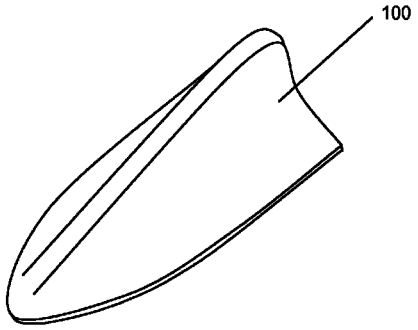
FIG. 1 shows a shark fin antenna unit.

One or more embodiments disclosed herein relates to a compact multiband antenna suitable for transmitting or receiving multiple frequencies. The antenna can have a single feed port and may be implemented as a vertically disposed substrate on a horizontal ground plane having conducting surfaces on both sides of the substrate. An open gap (which may also be referred to as a slot) is provided on a radiating conductor surface with a length related to the geometric mean of two main frequency bands of interest. The higher frequency band and the lower frequency band can be double resonance tuned by means of capacitive and inductive structures on the antenna substrate. Such structures can be provided by the conductive plates on both sides of the substrate.

Today there is a strong drive towards "green driving" that has resulted in several projects concerning "intelligent driving". New communication systems that are able to communicate between cars (car2car) and between a car and the roadside are in a definition phase. As yet there is no uniform global standard, but it is expected that the majority of such systems will work in the 5.8 to 6 GHz band.

Multiple antennas will need to be packed together in a small volume and positioned on the rooftops of vehicles in so called "antenna units". It is found that for car2car communication at least two antennas are required in order to combat multipath fading and to cope with the different relative directions of the cars. Multiple coaxial cables are required to connect the antennas to electronic devices. These cables pose a major cost burden. It is also expected that in future more electronic components will be positioned close to the antenna, in which case many of these expensive cables can be omitted.

It is known in the art that systems that use lower frequencies require a larger physical antenna. Thus the frequency band below 1 GHz will require more space than higher frequency transceivers. For example a monopole antenna for GSM900 requires a length of 77 mm. The available height for the antennas in a typical rooftop unit is around 50 mm. Reduction in antenna size is thus required, unfortunately this has been found to lead to lower fractional bandwidth and efficiency with known antennas.

Other systems that may be required for intelligent driving can include:

GPS: 1575.42±1.023 MHz

WLAN 5.9: 5.875-5.905 MHz

WLAN 2.4: 2.407-2.489 MHz

One or more embodiments of a multiband antenna disclosed herein can operate at a number of the previously mentioned communication standard frequencies whilst not interfering with other antennas located within the same housing that are being used to perform different telemetry tasks such as GPS.

Cellular communication is performed in several different frequency bands in different territories. In Europe the frequency bands below are currently used:

GSM 900: 880-960 MHz

GSM 1800: 1710-1880 MHz

UMTS: 1920-2170 MHz

Cellular communication in the USA currently uses the frequency bands described below:

GSM 850: 824-894 MHz

PCS: 1850-1990 MHz other frequency bands are foreseen for future use.

FIG. 1 shows a typical shark fin antenna unit 100 that may be placed at the rear of the rooftop of a vehicle. Antennas inside the antenna unit 100 are restricted in dimensions and the antennas have to be adapted to fit the unit 100. The antenna unit 100 also has stringent requirements for weather protection, shock behaviour and sensitivity to rises in temperature. The antenna unit 100 is encapsulated by a plastic radome.

Typical dimensions of the antenna unit 100 are:

maximum height of 50 to 55 mm (external radome height of 60 mm);

length of 120 mm (external radome length of 140 mm); and width of 40 mm (external radome width of 50 mm).

There is a fundamental relationship between the required operational signal frequency and the size of the antenna. A single resonant antenna element is proportional to the wavelength of the signal frequency to be received or transmitted. This means the higher the frequency of operation is, the smaller the antenna becomes. However, where a fixed frequency requirement exists, limiting the size of a prior art antenna so as to conform its dimensions to that of a standard housing has the effect of reducing its operational efficiency.

Figure 2:
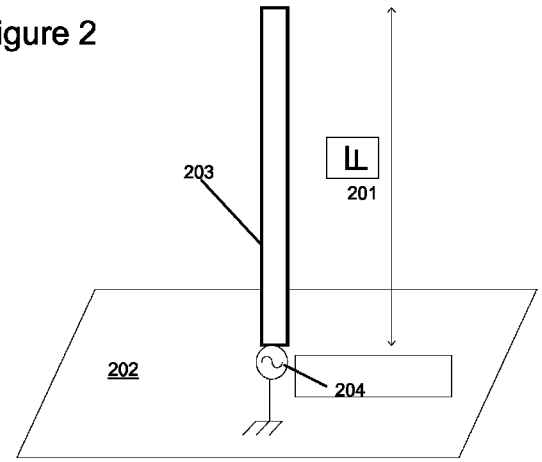
FIG. 2 shows a prior art monopole antenna.

FIG. 2 shows a prior art resonant quarter wave monopole antenna (length 201=0.25λ) above a ground plane 202.

The monopole 203 is fed radio frequency (RF) signals by feeding port 204. The feeding port signal is provided relative to the ground plate 202.

Lower frequency bands require a large antenna structure; for GSM900 a resonant monopole antenna length of 77 mm length is required, for 700 MHz a length of 87 mm length is required. Both of these lengths are too long to be implemented in a standard "shark fin" unit 100. Reduction in size is required, but this will reduce the important property of the fractional bandwidth that is attainable with known antennas. The fractional bandwidth (as a percentage) is defined as:

$$B_F = \frac{f_2 - f_1}{\sqrt{f_1 f_2}} \times 100$$

where $f_1$ and $f_2$ are the lower and upper frequencies of the frequency band, respectively.

$f_1$ and $f_2$ may be measured, for example, at a reference level of return loss of −10 dB. The return loss is the loss of signal at the antenna due to poorly matched impedance of the antenna and the line that feeds it; it is the loss due to reflected signal. The return loss is a parameter commonly used to define the quality of matching of the radio frequency signal to the antenna.

Figure 3:
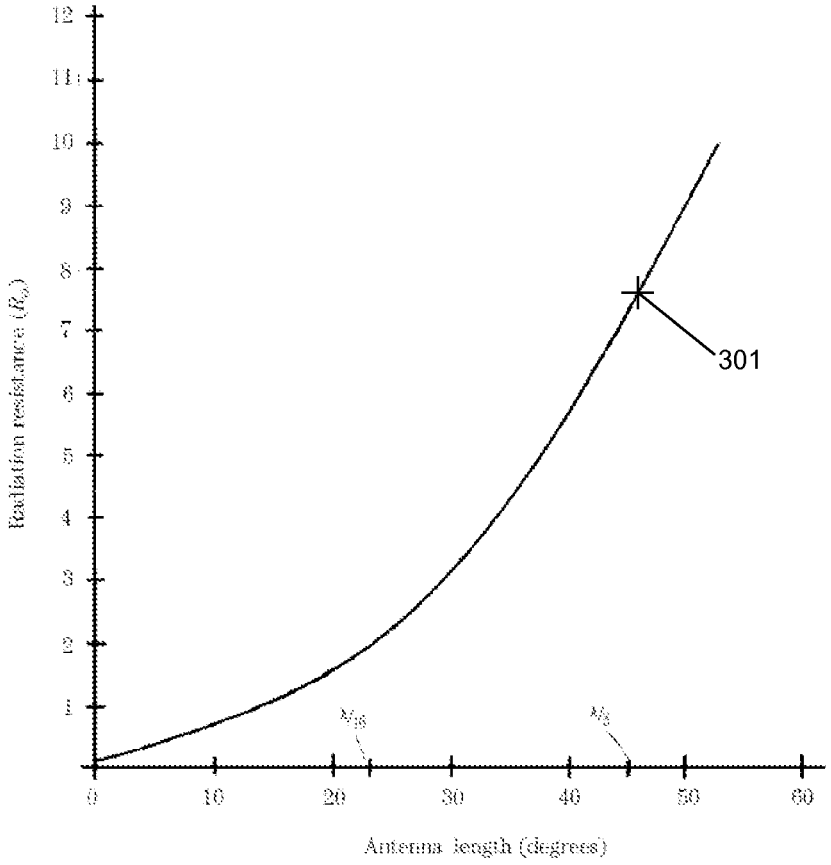
FIG. 3 shows the radiation resistance of a reduced size monopole antenna (reproduced from Practical Antenna Handbook, Joseph J. Car, McGraw-Hill, 4th edition)

FIG. 3 shows the radiation resistance of a monopole antenna for different antenna lengths. The antenna lengths are shown on the horizontal axis as proportions of a wavelength, where a complete wavelength equals 360 degrees. It can be seen that the radiation resistance is reduced to 8 ohms when the antenna length is reduced from 90 degrees (which is a quarter wavelength resonance monopole antenna) to 45 degrees at point 301. It is well known that reduced size antennas suffer from reduced radiation resistance, fractional bandwidth and efficiency.

Figure 4:
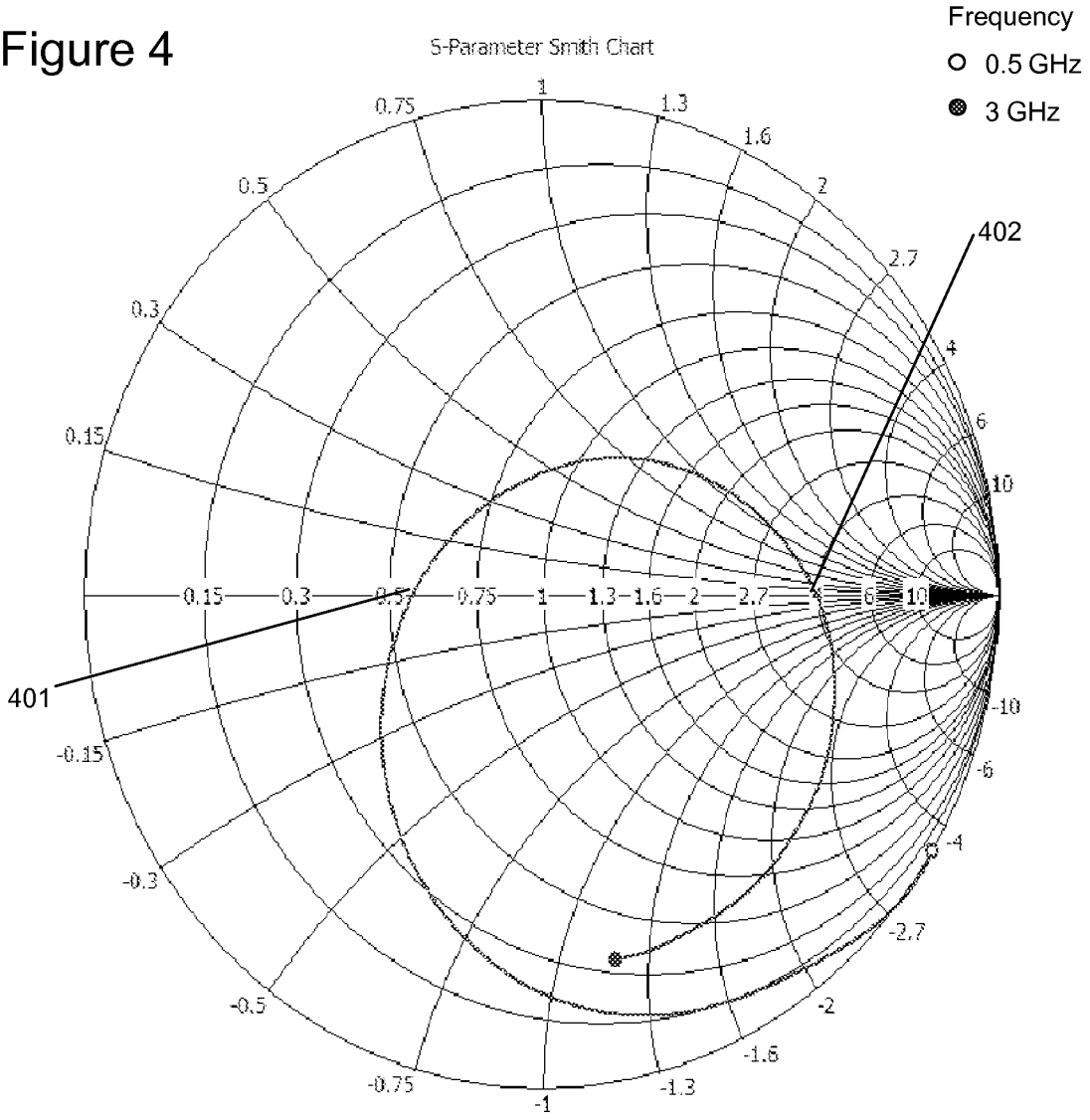
FIG. 4 shows a Smith chart of the complex impedance of the prior art antenna of FIG. 2 at frequencies between 0.5 GHz and 3 GHz.

FIG. 4 shows the simulated input impedance of the prior art antenna of FIG. 2 displayed on a Smith Chart. Simulations were performed using industry leading 3-dimensional electromagnetic simulators such as HFSS, from Ansoft Corporation or Microwave Studio from CST, Darmstadt Germany.

The Smith chart is a commonly used method of displaying complex information related to the impedance performance of an antenna. The circumferential axis shows the reactive coefficient of the antenna relative to a reference level of 50Ω. The horizontal axis shows the resistive coefficient relative to this reference level. The function plotted on the graph shows the two components of the impedance of the antenna at different frequencies. The frequency range plotted is from 0.5 GHz to 3 GHz starting from the open circle and finishing at the closed circle. The points where the function crosses the resistance axis (where the reactance coefficient is zero) are the first resonant frequency 401 and first anti-resonant frequency 402 for the prior art antenna.

Figure 5A:
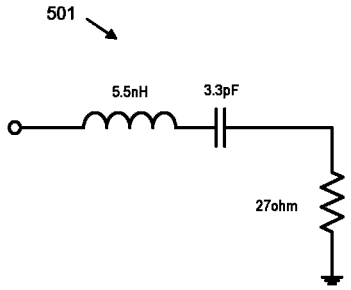
FIG. 5 shows equivalent circuit schematics for the prior art antenna of FIG. 2 at the first resonant and first anti-resonant frequencies shown in FIG. 4.
Figure 5B:
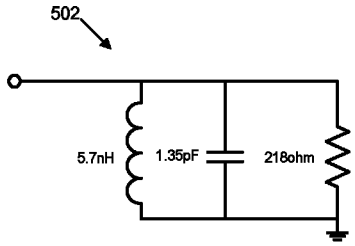

FIG. 5*a* shows the equivalent circuit schematic 501 of the impedance of the antenna of FIG. 2 operating at the first resonant frequency 401, shown in FIG. 4, and FIG. 5*b* shows the equivalent circuit schematic 502 of the impedance of the antenna operating at the first anti-resonant 402 frequency, also shown in FIG. 4. It can be seen that the equivalent circuit schematics 501, 502 include a resistor, capacitor and inductor to represent the complex information shown in FIG. 4. The equivalent circuit schematic 501 of FIG. 5*a* indicates that the impedance at the resonant frequency is equivalent to a series resonant circuit. The equivalent circuit schematic 502 of FIG. 5*b* indicates that the impedance at the anti-resonant frequency is equivalent to a parallel resonant circuit.

Figure 6:
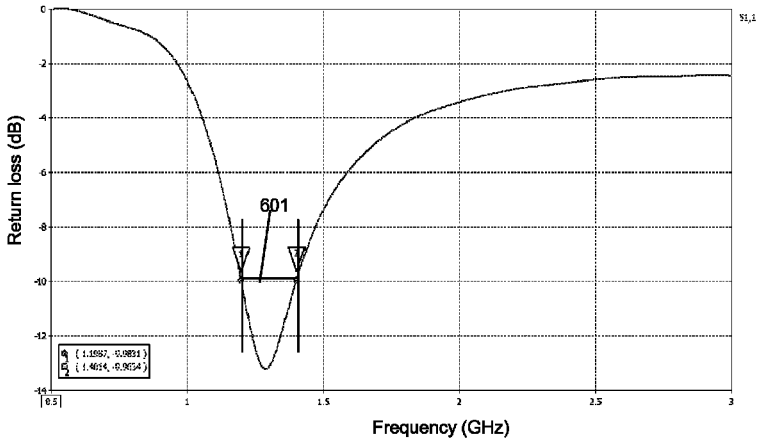
FIG. 6 shows the simulated return loss of the prior art antenna of FIG. 2 against its operating frequency.

The simulated return loss for this prior art antenna has been plotted in FIG. 6 against frequency. Using the reference level of return loss of −10 dB, which is the standard for acceptable RF performance in vehicle mounted antennas, the effective bandwidth 601 of the antenna is defined as approximately 1.2-1.4 GHz.

Figure 7:
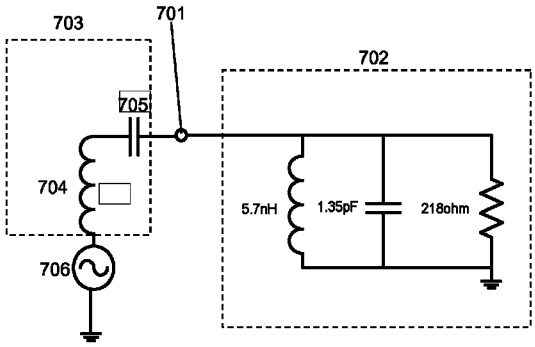
FIG. 7 shows the equivalent circuit for a double resonance tuned prior art antenna operating at the first anti-resonance frequency.

FIG. 7 shows schematically a circuit to illustrate the principle of double resonance tuning. Double resonance tuning partially compensates for the reactance of the antenna at the resonant frequency and increases the fractional bandwidth. Section 702 of FIG. 7 represents the equivalent circuit of the antenna operating at the first anti-resonant frequency (as illustrated in FIG. 5*b*) and is a parallel resonant circuit. The antenna is double resonance tuned by the addition of series-resonant section 703 which contains a capacitor 705 and inductor 704 in series. The capacitor 705 and inductor 704 have reactive properties configured to provide the opposite reactive properties to section 702 at the anti-resonant frequency 502. Double resonance tuning has the effect of both shifting the frequencies at which the resonant and anti-resonant frequencies occur, as well as a general reduction in antenna reactance at frequencies around the new resonant and anti-resonant frequencies. In this way the double resonance tuned antenna, consisting of both sections 702 and 703, is mainly resistive from the perspective of the RF signal source 706 for a greater range of frequencies around the anti-resonant frequency.

It will be appreciated that a similar method could be used to double resonance tune the antenna if it was required to operate at the first resonant frequency 401 shown in FIG. 4. In that case, the equivalent impedance of the antenna is a series resonant circuit (as shown in FIG. 5*a*) and would take the place of section 702 in FIG. 7. A parallel resonance circuit could be provided in place of section 703 in order to perform double resonance tuning.

In general a series resonance circuit can be used with a parallel resonance circuit in order to minimise or reduce the reactance of the antenna for a frequency range around a specific frequency, and vice versa for a series resonant circuit.

The values of the components 704, 705 for the additional resonance circuit 703 should be carefully chosen to compensate for the reactance of the antenna around the anti-resonant frequency in such a way that a desired bandwidth is obtained for a certain reference return loss. It will be appreciated that antennas operating at different resonant frequencies will require different component values for the double resonance tuning network.

Figure 8:
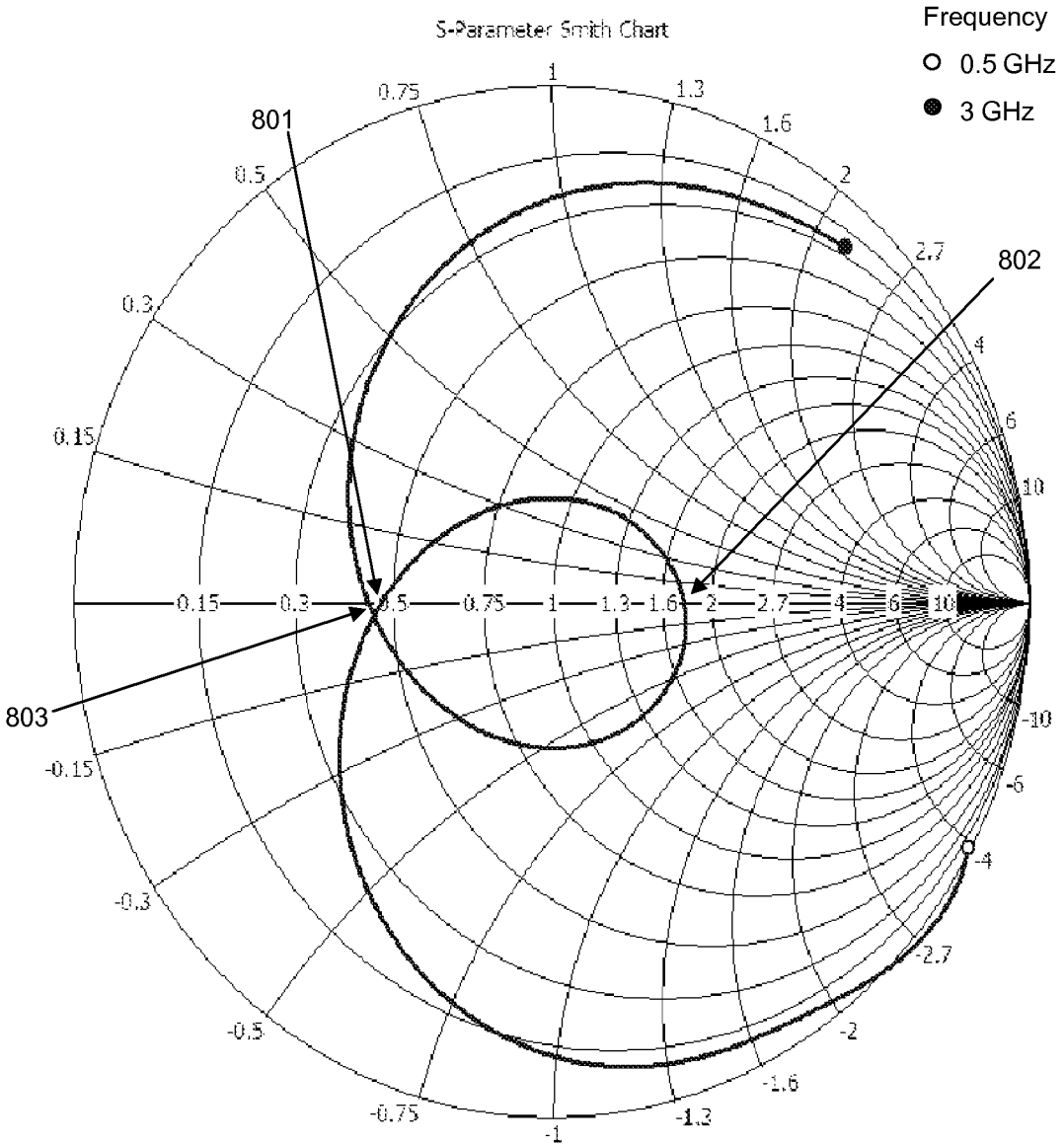
FIG. 8 shows a Smith chart of the complex impedance of the double tuned prior art antenna at frequencies between 0.5 GHz and 3 GHz.

FIG. 8 shows a Smith chart that illustrates the simulated input impedance of the prior art antenna of FIG. 2 using double resonance tuning. It can be seen that as well as the first resonant frequency 801 and first anti-resonant frequency 802, a second resonant frequency 803 is also apparent. Comparison of the Smith chart in FIG. 8 with that in FIG. 4 shows that a greater length of the frequency curve of the double resonance tuned antenna occupies the region near the horizontal axis. This means that the reactance is lower at a range of frequencies around the anti-resonant 402 frequency for the double resonance tuned antenna.

Figure 9:
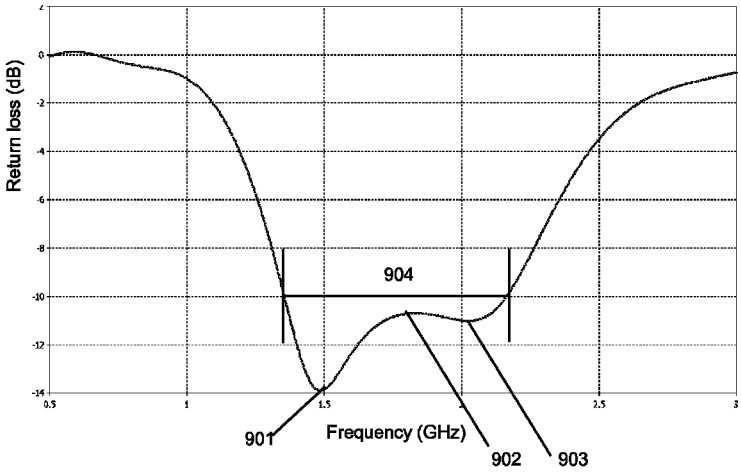
FIG. 9 shows the simulated return loss of the double tuned prior art antenna against its operating frequency.

FIG. 9 shows the return loss of the prior art antenna of FIG. 2 using double resonance tuning. FIG. 9 can be considered as illustrating some of the information of FIG. 8 in a more readily understandable way. The resonant frequencies 801, 802, 803 of FIG. 8 correspond to the minima 901, maxima 902, and minima 903 of the return loss profile of FIG. 9 respectively. It can be noted from FIG. 9 that the position of the first minima 901 is shifted to a higher frequency than was seen in FIG. 6. This frequency shift is due to the double resonance tuning applied to the antenna.

A comparison of the −10 dB return loss bandwidth 904 of the double tuned antenna shown in FIG. 9 with the bandwidth 601 of the prior art antenna in FIG. 6 without double tuning, shows that the usable bandwidth has increased by a factor of around 3. The bandwidth 904 of the double tuned antenna is about 0.7 GHz (1.4 to 2.1 GHz) compared to the bandwidth of 0.2 GHz in FIG. 6. The fractional bandwidth has also increased from 16% to 42%.

Figure 10:
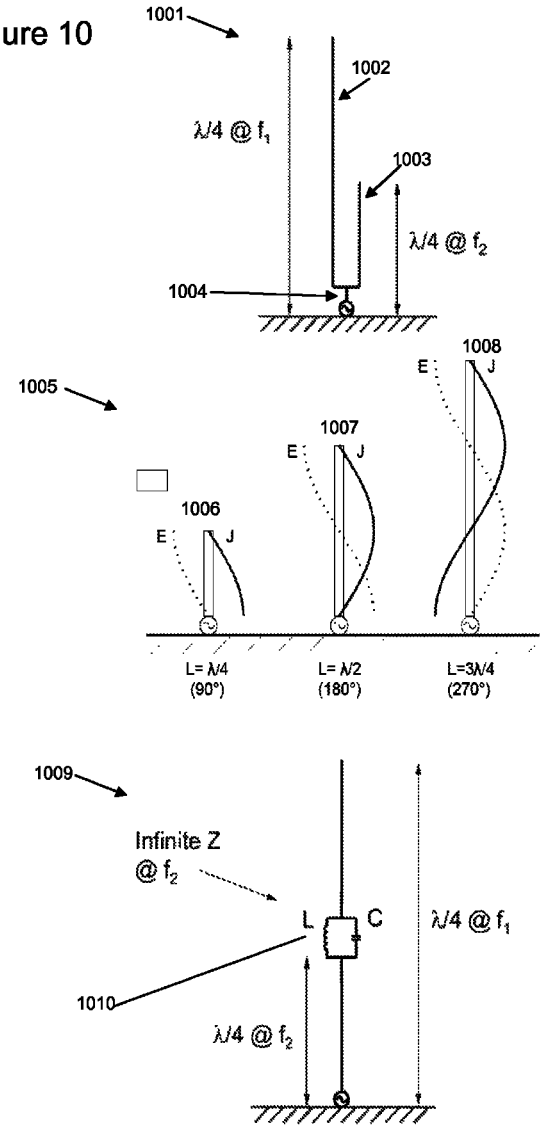
FIG. 10 shows a selection of prior art antenna configurations designed to operate at different frequency bands.

FIG. 10 shows several different prior art antennas that may be used to operate at different frequency bands.

Antenna 1001 has two resonant elements 1002, 1003 fed at a single port 1004.

Antenna 1005 makes use of higher order resonances. Usually higher order resonance can be moderately detuned without unduly influencing the first resonance mode. The expected 3 times λ/4 resonance 1008 will be lower in practice due to capacitive loading effects.

Antenna 1009 uses one (or more) pairs of parallel resonant traps 1010 that are placed in series with a quarter-wavelength structure or monopole. The purpose of the traps 1010 is to block resonant frequency $f_2$, whilst allowing resonant frequency $f_1$ to pass ($f_1$ and $f_2$ are as labelled in FIG. 10). Different electrical lengths can be obtained using this design scheme.

Figure 11:
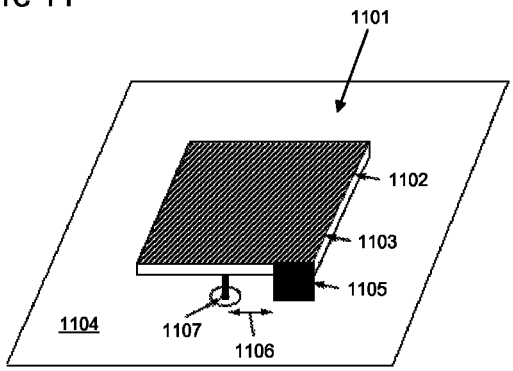
FIG. 11 shows a typical prior art planar inverted 'F' antenna.

FIG. 11 shows a prior art planar inverted 'F' antenna (PIFA) 1101. This type of antenna 1101 is often used by manufacturers in cellular telephone design. It is well suited to the aesthetic design of a cellular phone, which requires a low height antenna. The antenna structure is formed by a conductive plate 1102 deposited on a dielectric substrate 1103 displaced parallel from a ground plane 1104.

A quarter-wavelength PIFA antenna 1101 is a variant of the monopole antenna where a shorting pin 1105 is added at an extremity of the antenna and the feed port is displaced from the shorting element along the length of the antenna 1101. The shorting pin 1105 allows current to flow at the end of the antenna producing the same current voltage distribution that would be seen for a larger half wavelength antenna 1007. Decreasing the displacement 1106 between the feeding port 1107 and the shorting element 1105 has the effect of reducing the input impedance of the antenna. This property may be used to tune the input impedance of the antenna 1101 and allows a smaller conductive area 1102 to be used to generate the required RF response in the antenna having an acceptable return loss.

The above mentioned problems, that include a decreased input impedance of the prior art antenna that are required to have sub-optimal dimensions in order to be able to fit within a "shark fin" unit may be solved by several embodiments of the proposed new antenna. Embodiments of the new antenna further solve the problem of allowing the antenna to be tuned to two frequency bands, and provide for a method of independently tuning the frequency response of the two bands during the design of the antenna.

One or more embodiments of the invention relate to an antenna that uses double resonance tuning and may have the additional resonant components integrated into the antenna structure. This method introduces little or no extra cost for the antenna fabrication. Several embodiments disclosed herein provide a compact multiband antenna that can receive or transmit signals in various frequency bands.

Figure 12:
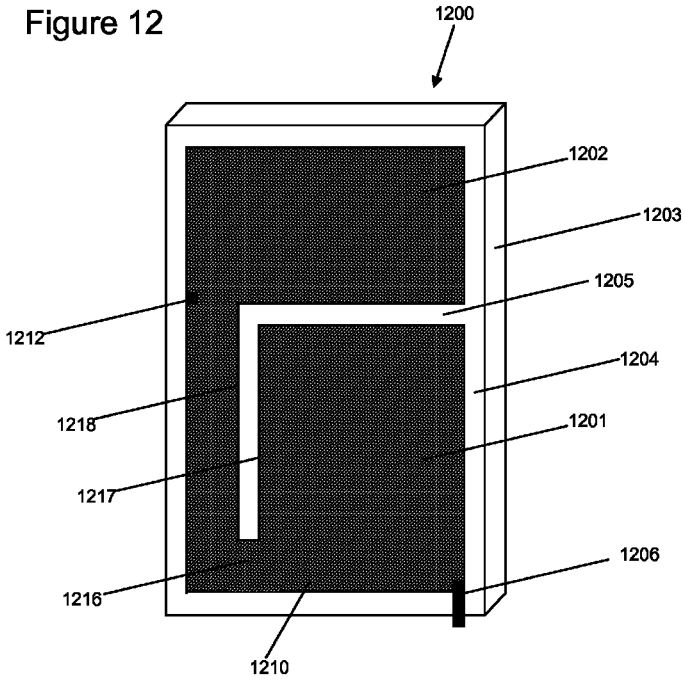
FIG. 12 shows a view of the front surface of a first embodiment of the present invention.

A front view of an antenna 1200 according to an embodiment of the present invention is shown in FIG. 12. The antenna 1200 is constructed on a substrate material 1203, such as on FR4 printed circuit board (PCB), which can act as a dielectric. Such a construction is very low cost to manufacture and has been proven to be adequately hardy for the harsh environments encountered in automobile applications.

A first conductive plate 1210 is present on a first surface 1204 of the substrate 1203. The first conductive plate 1210 consists of a first conductive region 1201 and a second conductive region 1202 that are separate by a gap 1205. The conductive regions 1201, 1202 may be created by etching away regions of the copper plate that is often found on PCBs in order to provide the gap 1205. It will be appreciated that any other suitable conductive material, such as any metal or a surface dopant that causes regions of the substrate to become conductive or semiconductive, may be used for any of the conductive plates disclosed herein.

The first and second conductive regions 1201, 1202 form surfaces of the antenna that may be used to radiate or receive RF signals. The area of the second conductive region 1202 forms an inverted 'L' shape around the contours of the area of the first conductive region 1201, which in the embodiment shown is broadly rectangular. This configuration has been found to occupy a small amount of PCB space and so aids in the task of accommodating the antenna in a confined space, such as within a radome fin of a vehicle.

In the embodiment shown, the two regions 1201, 1202 are coupled together at position 1216, which can be considered as forming a closed end of the gap 1205. Position 1216 can be considered as a coupling regional 1216 of the first conductive plate 1210. In such embodiments, the two regions 1201, 1202 meet at a position proximal to a signal terminal 1314*a* of a feeding port 1314 (described below in relation to FIG. 13) which is at or near to this position in the plane of the substrate on its reverse face. An edge 1217 of the first conductive region 1201 and an edge 1218 of the second conductive region 1202 are separated by the gap 1205 where there is no conductive material.

The first and second conductive regions 1201, 1202 are designed to resonate at a higher frequency band (primarily due to region 1201) and a lower frequency band (primarily due to region 1202, although also involving region 1201). The gap 1205 that separates the regions 1201, 1202 is designed to have a length related to the geometric mean of the wavelengths of the two frequency bands.

$$L = \frac{c\gamma}{4(f_{Low1} f_{Low2} f_{High1} f_{High2})^{\frac{1}{4}}}$$

where L is the length of the slot of an antenna designed to be operated at a high frequency band defined within the upper frequency limit of $f_{High2}$ and the lower frequency limit of $f_{High1}$, and a low frequency band defined within an upper frequency limit of $f_{Low2}$ and a lower frequency limit of $f_{Low1}$. The constant c is the speed of light and gamma is an empirically derived correction factor, which in practice has been found to be close to 0.75. The fourth root of the product of the frequency band's limits provides the geometric mean of the antenna operating frequency. The right hand side of the equation must be divided by four as this is a quarter-wavelength antenna design.

It will be appreciated that gap 1205 may also be constructed with different dimensions in other embodiments. For example the above equation can be used to obtain a starting point for the length of the slot that can be used in simulations to further refine the length. The simulations can be used to improve the value of length by taking into account the dielectric effect of the substrate and other characteristics that might be difficult to model mathematically.

In this example, the frequency band related to the first conductive region 1201 is relative wide due to its large lateral width and can be used for multiple communication standards.

A shorting element 1206 is connected at an extremity of the first conductive region 1201 and can be coupled to a ground plane (not shown) when in use. The shorting element 1206 increases the input impedance for the lower frequency band which would otherwise be insufficient, for example 8 to 10 ohms. This is because the antenna height of this embodiment is physically smaller than that required for the lower frequency band without the use of the additional impedance increasing means. The distance between the shorting element 1206 and the signal terminal 1314*a* of the feeding port 1314 affects the input impedance of both frequency bands.

Figure 13:
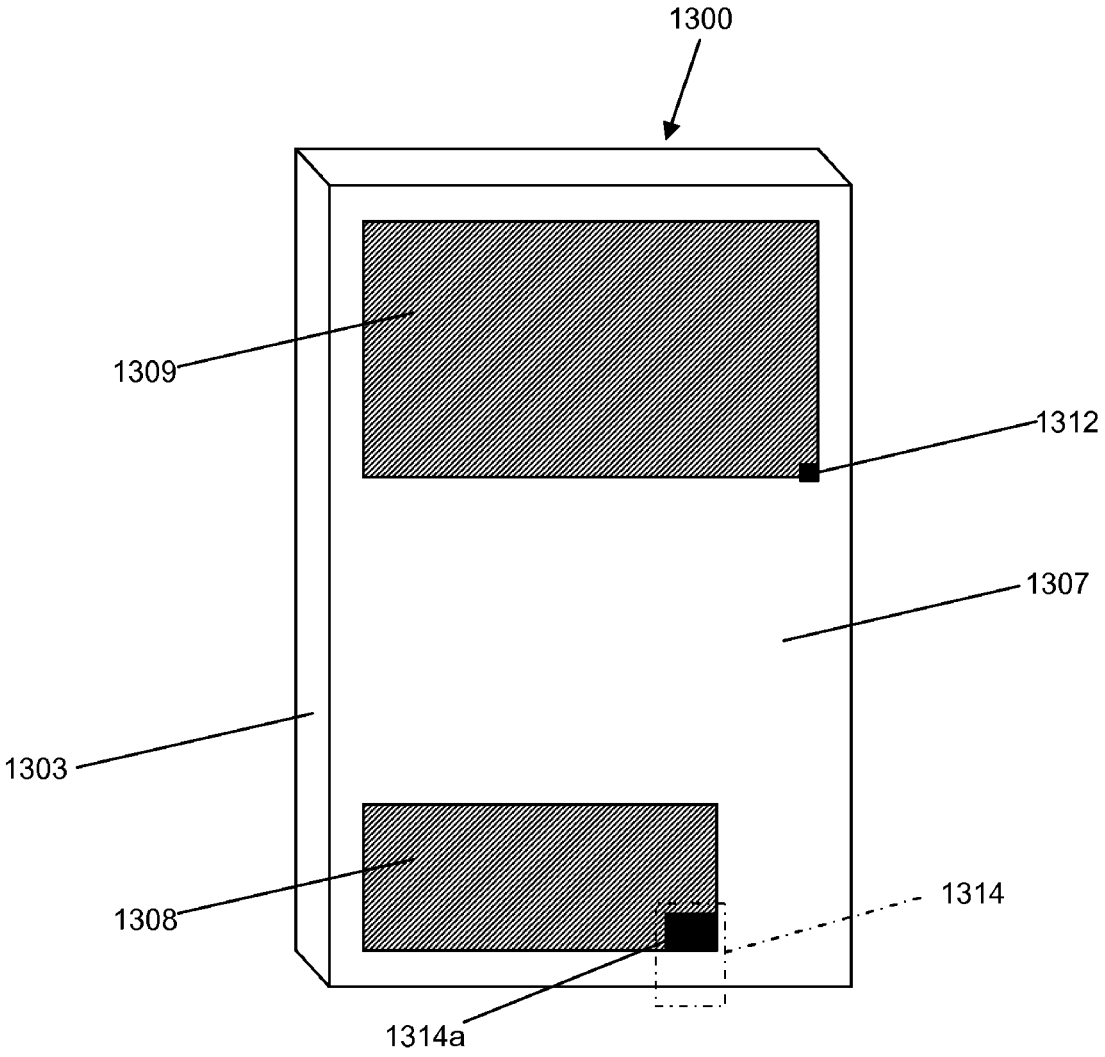
FIG. 13 shows a view of the rear surface of a first embodiment of the present invention.

FIG. 13 shows the reverse, second surface 1307, of the substrate 1303 of the antenna of FIG. 12. A second conductive plate 1308 is shown in this embodiment on the reverse surface 1307 of the substrate 1303 in a position that allows it to be capacitively coupled with the first conductive region 1201 on the first surface of the substrate (as shown in FIG. 12). The second conductive plate 1308 is coupled to an RF signal source (not shown) through the signal terminal 1314*a* of the feeding port 1314. The signal terminal 1314*a* can, whilst in use, be coupled to the inner wire of a coaxial cable. The signal provided by the signal terminal 1314*a* drives the first 1201 and second 1202 conductive regions on the first surface of the antenna through this capacitive coupling between the first conductive plate 1210 and the second conductive plate 1308. The amount of capacitance provided by the second conductive plate 1308 can be altered by changing its location on the second surface 1307 of the substrate 1303, or its size. As well as providing RF signal driving, the capacitance value of the second capacitance plate 1308 can be used to provide the opposite reactance to that of the first conductive region 1201 of the antenna 1200, so as to implement a double resonance tuning method for the higher frequency band, as discussed above.

A third conductive plate 1309 is also positioned on the rear surface 1307 of the substrate 1303. This third conductive plate 1309 is positioned so that it may provide capacitance to the second conductive region 1202 on the first surface 1204 of the substrate 1203. This capacitance value can be used to provide the opposite reactance to that of the second conductive region 1202 of the antenna, and therefore apply double resonance tuning functionality for the lower frequency band. Inductance is formed by means of positioning a connection via 1212, 1312 that provides a direct electrical connection between the third conductive plate 1309 on the second surface 1307 and the second conductive region 1202 on the first surface 1204. The provision of both inductive and capacitive reactance by the third conductive plate 1309 opposes the reactance of the second conductive region 1202 when operated in the desired frequency range. The third conductive plate 1309 may not have any significant effect, in terms of capacitance and inductance, on the first conductive region 1201 on the first surface 1204, and therefore may not significantly affect the response of the higher frequency band. Therefore, the two frequency band responses can be precisely controlled independently.

The ability to independently tune the higher and lower frequency bands by altering the properties of the second and third conductive plates 1308, 1309 that provide impedance to the first and second conductive regions 1201, 1202 of the first conductive plate 1210 provides for a multiband antenna 1200, 1300 offering excellent performance at tailored frequencies whilst occupying less space than would be required by prior art antennas.

Figure 14:
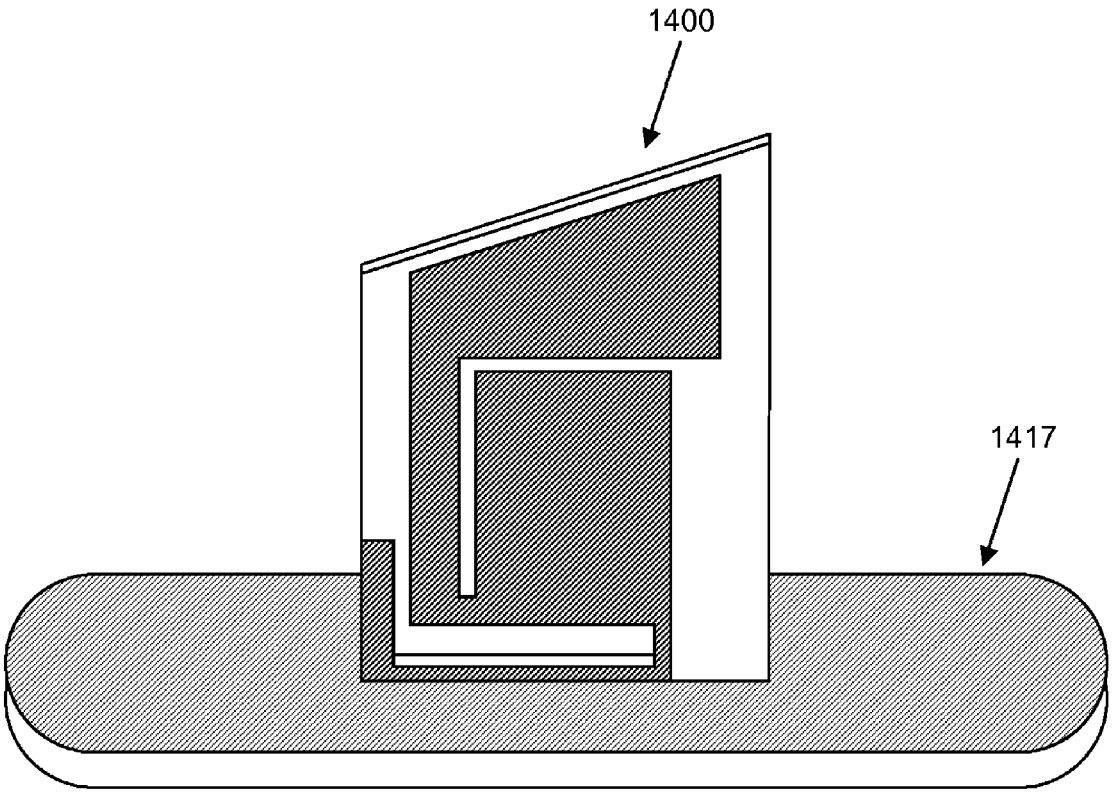
FIG. 14 shows a schematic diagram of an antenna according to a second embodiment of the present invention mounted on a ground plane.
Figure 15:
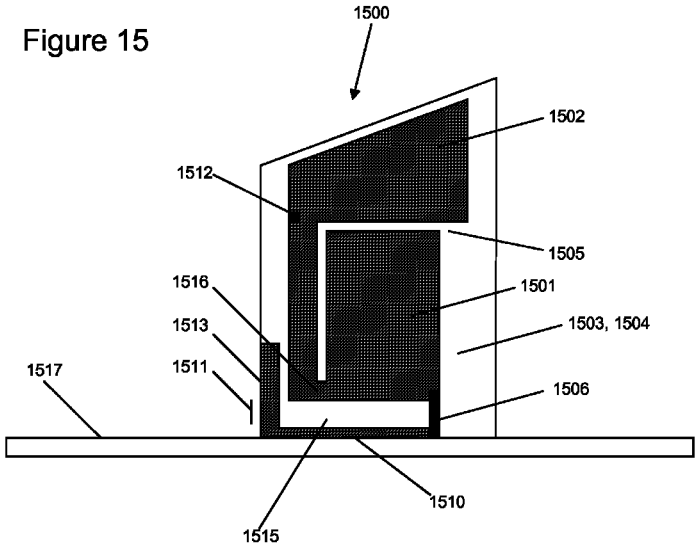
FIG. 15 shows a front view of a second embodiment of the present invention.
Figure 16:
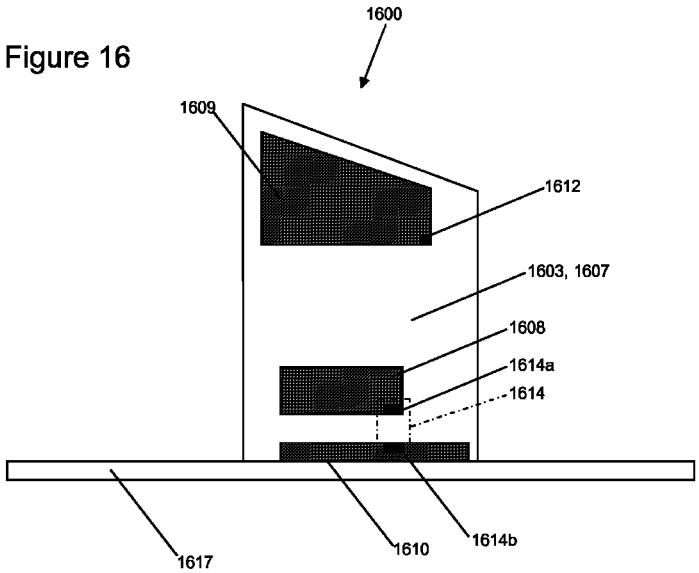
FIG. 16 shows a back view of a second embodiment of the present invention.

A further embodiment of an antenna 1400 coupled to a ground plate 1417 is shown in FIG. 14. The front view of this antenna is shown in FIG. 15 and a back view is shown in FIG. 16. This embodiment illustrates an antenna 1500 whereby the radiating plates 1501, 1502 are not parallel to a ground plate 1517, instead they are folded to a generally vertical position, that is substantially orthogonal to a ground plate 1517. As with the previous embodiment, the antenna substrate has two sides 1504, 1607 that may be coated in conducting materials.

Since the proposed new antenna uses the method of double resonance tuning and has the additional required resonance components integrated into the antenna structure, the values of the integrated components can be selected so as to be suitable for all frequency bands. Nevertheless different frequencies can require different values for the integrated components.

The above mentioned problems of decreased input impedance can be solved by this embodiment of the proposed new antenna which, although it has smaller physical height than a quarter wavelength of the lower frequency band, increases the input impedance and the fractional bandwidth of the antenna by means of the feeding method described above.

The antenna 1500 of FIG. 15 consists of a planar structure on a substrate 1503. The antenna 1500 is of the monopole type and can operate above a ground plane 1517. The antenna 1500 has a single feeding port 1614 on the reverse surface of the antenna (shown in FIG. 16). A signal terminal 1614*a* of the feeding port 1614 is located on the second conductive plate. The signal terminal 1614*a* may be connected to radio integrated circuitry via the inner wire of a coaxial cable. Such circuitry may relate to satellite communications or navigation, cellular telephony, data telephony or radio broadcasting. The outer screening portion of the feeding coaxial cable may be attached to the ground plate 1517 or, as shown in FIG. 16, to the fifth conductive plate 1610 using a ground terminal 1614*b* of the feeding port 1614. The ground terminal 1614*b* of the feeding port 1614 is positioned on the fifth conductive plate 1610 in this embodiment.

Two operational frequency bands are created by means of providing an open gap 1505 with length related to the geometric mean of the required frequency bands partially separating the conductive regions 1501, 1502. As with the previously described embodiment, the first 1501 and second 1502 conductive regions are coupled at position 1516 on the substrate 1503. The distance between the antenna 1500 and a ground plate 1517 can be better defined by including a grounding bar 1510, 1610 on the substrate 1503 on either or both surfaces 1504, 1607 of the substrate 1503. This creates a precise fixed distance between a grounded conductor (the grounding bar 1510, 1610) and the first conductive region 1501 so that mounting the antenna 1500 on grounding plate 1517 during assembly will not create a different distance 1511 than that expected and designed for. Variation in this distance 1511 would cause a change in the performance characteristics of the antenna 1500. The grounding bar 1510 can be provided as a fourth conductive plate 1510 on the first surface 1504 of the substrate 1503 and/or a fifth conductive plate 1610 on the second surface 1607 of the substrate 1603.

FIG. 16 shows the reverse, second surface 1607, of the antenna 1600. This side 1607 is used for feeding the antenna. The feeding port 1614 in this embodiment is located on the second surface 1607 of the substrate 1603 proximally, in the plane of the substrate 1303, with position 1516 on the first surface 1504 of the substrate 1503.

The second conductive plate 1608 is driven by the signal terminal (1614*a*) of the feeding port 1614 to create a double resonance tuning effect, as discussed above. The second conductive surface 1608 is positioned between the shorting port 1506 on the first surface 1504 of substrate 1503, and the feeding port 1614 to which it is coupled. In this embodiment the position of the second conductive surface 1608 is chosen to influence the higher frequency band. Inductance between the ground and the first conductive plate 1502 is formed by the surface area 1515 bounded by the shorting element 1506, the first conductive region 1501, the grounding bar 1510, 1610 and the feeding port 1614. Together with the series capacitance formed by 1608 and 1501, such a structure creates an additional series resonance circuit that provides double resonance tuning for the higher frequency band.

A second double resonance tuning is provided by means of a third conductive plate 1609 that enlarges the fractional bandwidth of the lower frequency band. The third conductive plate 1609 is located so that it overlaps at least a portion of the second conductive region 1502 on the other side of the substrate. In this way capacitance is provided there between.

The input impedance of the lower frequency band can be increased by adjusting the position of the feeding port 1614. If the feeding port 1614 is further from the shorting element 1506 then the input impedance increases. This modification also provides more inductance for the double resonance tuning.

Using the embodiment described above it has been found that the input impedance of the higher band can be too high due to the effect of the shorting pin 1506 and the feeding port 1614 position. To reduce the input impedance for the higher frequency band, a further embodiment provides a tuning bar, also referred to as sixth conductive plate 1513 as shown in FIG. 15.

The tuning bar 1513 is connected to the ground and positioned close to the second conductive region 1502 so that it provides inductance between the second conductive region 1502 and the ground. It has been found that this tuning bar 1513 influences the input impedance mainly at the higher frequency band, without significantly influencing the input impedance of the lower frequency band.

In the embodiment of FIG. 15, the tuning bar 1513 extends in a longitudinal direction from the grounding bar 1510 and extends to a position adjacent to, but spaced apart from, the second conductive region 1502 in order to provide the required input impedance.

During design, embodiments of the new multiband antenna 1200, 1300, 1400, 1500, 1600 can be easily tuned at the lower frequency band by means of adapting the dimensions of the open slot/gap 1205, 1505 and can be fine tuned by adapting the shape of the second conductive region 1202, 1502. Such design consideration may be required during the planning of how the antenna will be housed because the second conductive region 1202, 1502 can suffer from dielectric loading from the radome of the antenna unit 100.

Figure 17:
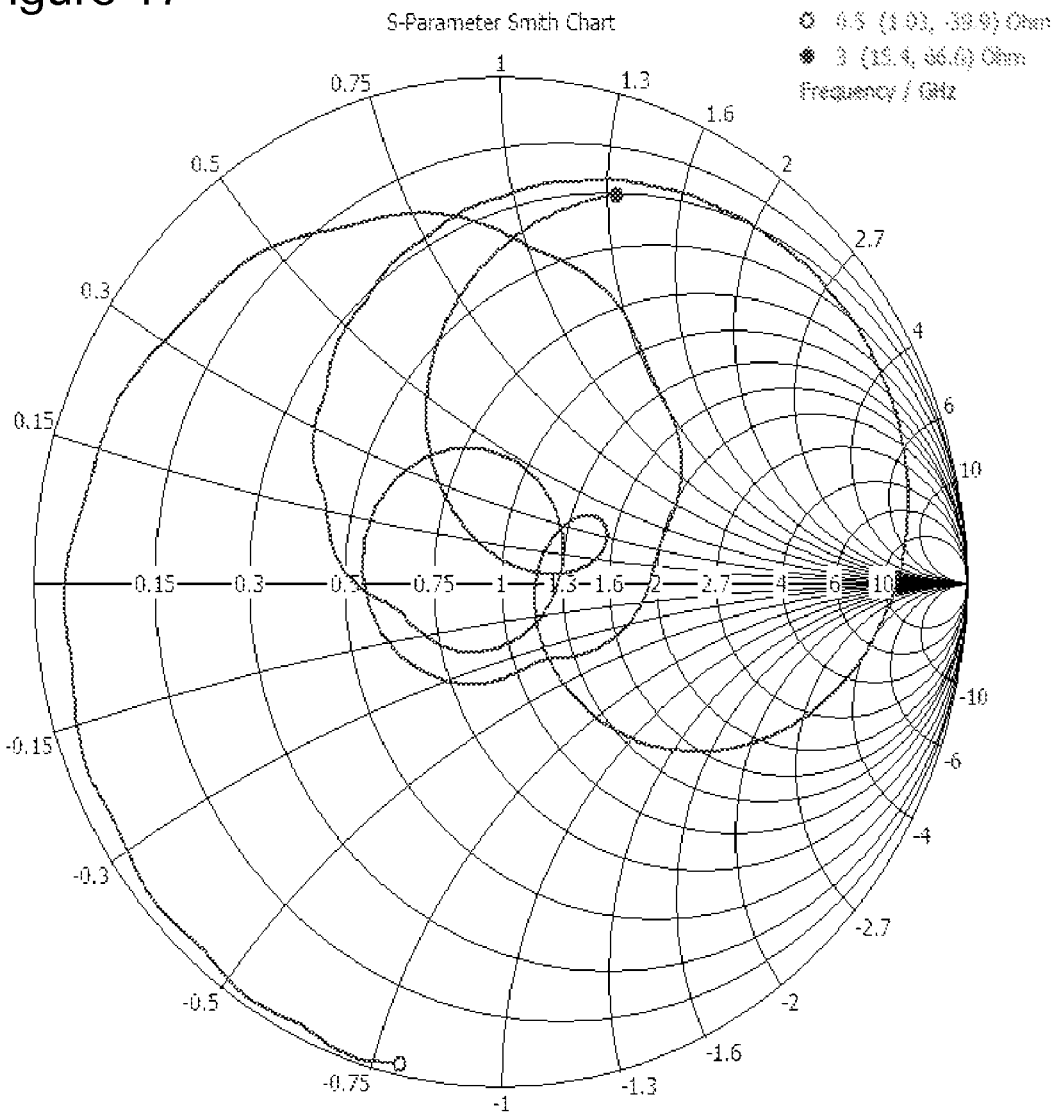
FIG. 17 shows a Smith chart of the complex impedance of the antenna shown in FIGS. 14 to 16 at frequencies between 0.5 GHz and 3 GHz.

FIG. 17 shows the simulated input impedance of the proposed multiband antenna. The multiple points where the line intersects the horizontal axis indicate the many resonant and anti-resonant frequencies. These are shown as the minima and maxima in the simulated return loss against frequency chart in FIG. 18.

Figure 18:
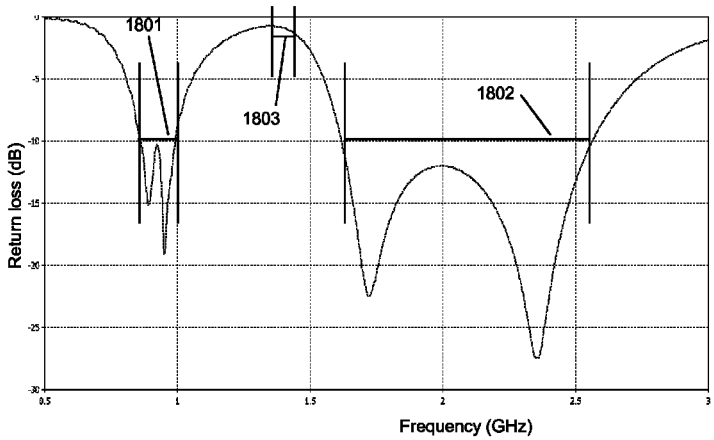
FIG. 18 shows the simulated return loss of the antenna shown in FIGS. 14 to 16 against its operating frequency.

FIG. 18 shows the simulated return loss of a reduced size multiband antenna that is 50 mm high and 25 mm wide on a 1.6 mm FR4 standard printed circuit board material. A lower frequency band 1801 and an upper frequency band 1802 with return loss below −10 dB are provided by the embodiment shown in FIGS. 14 to 16. This embodiment of the proposed new multiband antenna has a reduced size when compared with the prior art and can be used for several standards, such as:

GSM 900: 880-960 MHz
GSM 1800: 1710-1880 MHz
UMTS: 1920-2170 MHz
GSM 850: 824-894 MHz
PCS: 1850-1990 MHz
WLAN 2.4: 2.404-2.489 MHz
as well as other future standards.

It will be appreciated that this embodiment is only an example, and other dimensions of the antenna can be used for other frequency bands.

Figure 19:
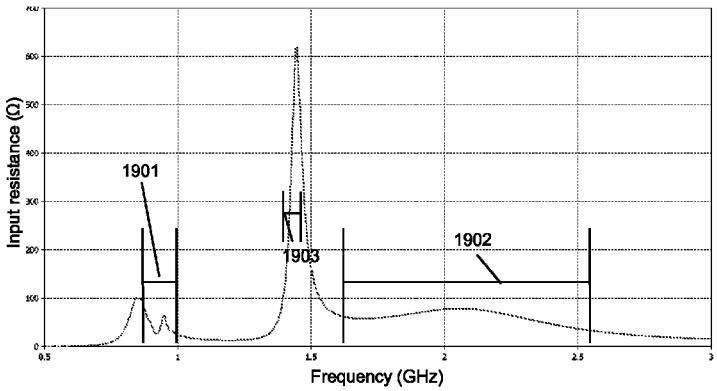
FIG. 19 shows the simulated input resistance of the antenna shown in FIGS. 14 to 16 against its operating frequency.
Figure 20:
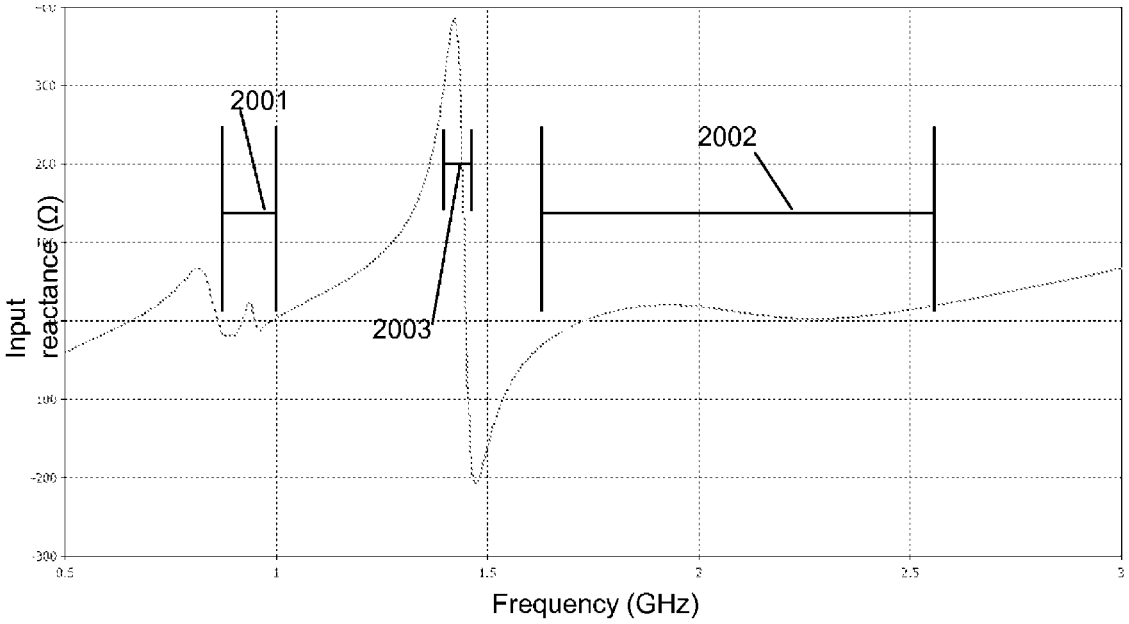
FIG. 20 shows the simulated input reactance of the antenna shown in FIGS. 14 to 16 against its operating frequency.

FIGS. 19 and 20 show the simulated input resistance and reactance of the embodiment of the multiband antenna shown in FIGS. 14 to 16. The input resistance is relatively stable within the frequency bands of interest 1901, 1902. The reactance within the two frequency bands 2001, 2002 is close to zero because of the compensation provided by the separate double resonance tuning applied to the lower and upper frequency bands.

Another useful property of the antenna is the suppression band that may be formed by suitable selection of component attributes. This suppression band can be seen at around 1.4 GHz in FIGS. 18 to 20. In the suppression band the return loss, input reactance and input impedance are all very high. The effect of this is that this antenna 1400, 1500, 1600 can be used in close proximity to another antenna operating at the 1.4 GHz frequency range whilst causing minimal interference to the operation of the other antenna. This suppression band can, for example be used to block interference with a GPS antenna operating at 1575.42±1.023 MHz. It is envisaged that such an embodiment of the multiband antenna would be suitable for housing within the same radome as a GPS antenna.

The invention claimed is:

1. A multiband antenna comprising:

a substrate having a first front surface and a second rear surface and a plane;

a first conductive plate on the first front surface of the substrate, the first conductive plate comprising a first conductive region and a second conductive region, wherein the first conductive region is coupled to ground by a shorting element, and the first conductive region and second conductive region are located so as to define a gap therebetween;

a second conductive plate on the second rear surface of the substrate, the second conductive plate directly coupled to a signal terminal of a feeding port, wherein the second conductive plate is aligned to provide capacitance with the first conductive region;

a third conductive plate, not directly coupled to the second conductive plate on the second rear surface of the substrate, wherein the third conductive plate is aligned to provide capacitance with the second conductive region; and a connecting conductor configured to electrically couple the third conductive plate to the second conductive region.

2. The multiband antenna of claim 1, wherein the first conductive region and the second conductive region are coupled at a coupling region of the first conductive plate on the first front surface of the substrate, and the coupling region is aligned in the plane of the substrate with a position of the feeding port on the second rear surface of the substrate.

3. The multiband antenna of claim 1, wherein the signal terminal of the feeding port is configured to be coupled to a wire of a coaxial cable for conducting transmit and receive signals.

4. The multiband antenna of claim 1, wherein the second conductive plate is aligned with relation to a position of the second conductive region of the first conductive plate to capacitively drive the first conductive plate.

5. The multiband antenna of claim 1, wherein the first conductive region of the first conductive plate is configured to transmit or receive a signal in a first frequency band and a combination of the first conductive region and the second conductive region of the first conductive plate are configured to transmit or receive a signal in a second frequency band, and wherein the first frequency band is at a higher frequency than the second frequency band.

6. The multiband antenna of claim 1, wherein the first conductive region of the first conductive plate is substantially rectangular and the second conductive region of the first conductive plate is substantially the shape of an inverted 'L', and the gap is a separation between an edge of the first conductive region and a facing edge of the 'L' shaped second conductive region.

7. The multiband antenna of claim 1, further comprising:

a fourth conductive plate on the first front surface of the substrate, wherein the fourth conductive plate is coupled to the shorting element and coupled to ground, and the fourth conductive plate is configured to, in combination with the shorting element, provide inductance with the first conductive plate.

8. The multiband antenna of claim 1, wherein the first conductive region is further configured to provide inductance between the signal terminal of the feeding port and ground.

9. The multiband antenna of claim 1, wherein the second conductive plate is further configured to provide inductance between the signal terminal of the feeding port and ground.

10. The multiband antenna of claim 1, further comprising:

a via that is configured to electrically couple the second conductive region and the third conductive plate by a direct electrical connection.

11. The multiband antenna of claim 1, further comprising:

a ground plate, wherein the first conductive plate is coupled to the ground plate by the shorting element, and the substrate extends in a direction that is substantially perpendicular to the ground plate.

12. The multiband antenna of claim 7, further comprising:

a fifth conductive plate on the second rear surface of the substrate, wherein the feeding port comprises a ground terminal that is configured to be coupled to the fifth conductive plate.

13. The multiband antenna of claim 12, wherein the ground terminal of the feeding port is configured to be coupled with a screening member of a coaxial cable.

14. The multiband antenna of claim 12, further comprising:

a sixth conductive plate on the first front surface of the substrate, wherein the sixth conductive plate is coupled to ground and configured to provide impedance between the second conductive region and ground to affect the frequency input impedances of a higher frequency band.

15. The multiband antenna of claim 14, wherein the sixth conductive plate extends longitudinally from a ground plane such that at least a portion of the sixth conductive plate runs generally parallel to the second conductive region.

* * * * *